US009883988B1

(12) United States Patent
Kumbasi et al.

(10) Patent No.: US 9,883,988 B1
(45) Date of Patent: Feb. 6, 2018

(54) PACIFIER HOLDER

(71) Applicant: Innovost, LLC, Allen, TX (US)

(72) Inventors: Amit G. Kumbasi, Allen, TX (US); Raymond Ochotorena, Jr., Vail, AZ (US)

(73) Assignee: Innovost, LLC, Allen, TX (US)

( * ) Notice: Subject to any disclaimer, the term of this patent is extended or adjusted under 35 U.S.C. 154(b) by 0 days.

(21) Appl. No.: 14/918,450

(22) Filed: Oct. 20, 2015

Related U.S. Application Data

(60) Provisional application No. 62/122,414, filed on Oct. 20, 2014.

(51) Int. Cl.
*A61J 17/00* (2006.01)
*B65D 25/02* (2006.01)
*B65D 47/32* (2006.01)

(52) U.S. Cl.
CPC ..... *A61J 17/001* (2015.05); *A61J 17/00* (2013.01); *B65D 25/02* (2013.01); *B65D 47/32* (2013.01); *A61J 17/008* (2015.05)

(58) Field of Classification Search
CPC ..... A61J 17/001; A61J 17/00; A61J 17/008; B65D 25/02; B65D 25/05; B65D 47/32
USPC ..... 206/210; 220/485–489; 606/234; 211/41.3; 3/210; 215/11.6; 15/209.1
See application file for complete search history.

(56) References Cited

U.S. PATENT DOCUMENTS 3,505,007 A * 4/1970 Green ..... A61L 2/07 206/205
4,498,594 A * 2/1985 Elder ..... A47L 15/505 134/137
5,606,871 A * 3/1997 Hansen ..... A61J 17/00 606/235
6,343,612 B1 * 2/2002 Dahl ..... A61L 2/18 134/117
8,087,519 B2 * 1/2012 Bramley ..... A47L 15/505 211/41.3
8,317,040 B2 * 11/2012 Lanning ..... A47B 88/20 108/60
2003/0217423 A1 * 11/2003 Larsen ..... A61L 2/26 15/104.92
2005/0258204 A1 * 11/2005 Evans ..... A45F 5/02 224/197
2006/0065666 A1 * 3/2006 Dunn ..... A47L 15/505 220/676
2015/0048091 A1 * 2/2015 Chan ..... A47L 15/505 220/485
2015/0201770 A1 * 7/2015 Hureau ..... A47G 19/02 220/574

* cited by examiner

*Primary Examiner* — Chun Cheung
(74) *Attorney, Agent, or Firm* — Southern Methodist University Dedman School of Law

(57) ABSTRACT

Pacifier holder comprises of a cup, a rubber insert, a lid, a rotating handle designed to hold and safe-keep one pacifier, collect saliva, vent for nibble drying and entertain baby by animal shapes of other means, including vivid color and pictures. It eliminates the customary lanyard design and prevents pacifier contamination. It is dishwasher safe and may incorporate evaporative sanitizing or medicating means. It can be attached to bassinet, stroller, cribs, swing, chair, tables and wall using a rubber or nylon belt or a bar. It can also be secured by sticky tape or Velcro or magnet. Its attachment handle rotates full turn.

19 Claims, 4 Drawing Sheets

PACIFIER HOLDER

RELATED APPLICATION

This application claims priority to U.S. Provisional Application No. 62/122,414, filed Oct. 20, 2014, which is incorporated herein by reference in its entirety.

FIELD OF THE INVENTION

This invention relates to portable containers of various shapes, used to temporarily store baby products, including but not limited to pacifiers, cleansing wipes, snacks, etc., in a way that is secure, hygienic and easily accessible.

SUMMARY OF THE INVENTION

The above problem and others are at least partially solved in an apparatus and process, which according to the teachings of this invention, uses a cup, which is sized to hold a pacifier and has means to rotate and can be attached to something handy (for instance, bassinet, stroller arm or handle, crib rails, clip ends, swing bar or car seat) for the purposes of quick accessibility of the pacifier for the baby (or the parent) to use it safely, not worrying about getting contaminated since the last use.

In one representative embodiment of the invention, there is a cup shaped container, that is easy to rotate and can be attached or tied to various surfaces, for the purposes of keeping the pacifier clean for the baby, especially while traveling or at playgrounds or other indoor and outdoor areas, where dropping a pacifier would call for washing it before the baby can use it again. The embodiment further incorporates a compliant insert, which facilitates proper positioning of the pacifier with nibble end down, preferably has a lid to keep contamination out when not in use. Weep holes add ventilation to dry saliva before the next use.

This embodiment provides a simple and useful solution to the problem of pacifier getting contaminated either by dangling from baby's dress or by keeping it on an unclean surface, which however can even be lifesaving by preventing the contamination of the pacifier. Storing the pacifier securely inside the rotating cup prevents the risk of contamination and allows for future use of the pacifier without the need for rewashing it. Pacifiers hanging from the neck by lanyard or attached by a clip to the baby's dress, obviously deficient in this capacity, represents the current ubiquitous practice as state-of-art solution, mainly because it is believed to assist baby teething.

BRIEF DESCRIPTION OF THE DRAWINGS

Referring to the drawings:

FIG. 4 is yet another section view of yet another pacifier holder with snap in insert retainer and a swivel lid with a pacifier dropping in.

DETAILED DESCRIPTION OF A PREFERRED EMBODIMENT

The container may be made out of plastic, wood, metal, silicon, elastomer, rubber, or any combination of these materials.

The insert may be made out of plastic, wood, metal, silicon, elastomer, rubber, or any combination of these materials.

The handle may be made out of plastic, wood, metal, silicon, elastomer, rubber, or any combination of these materials.

Figure 1:
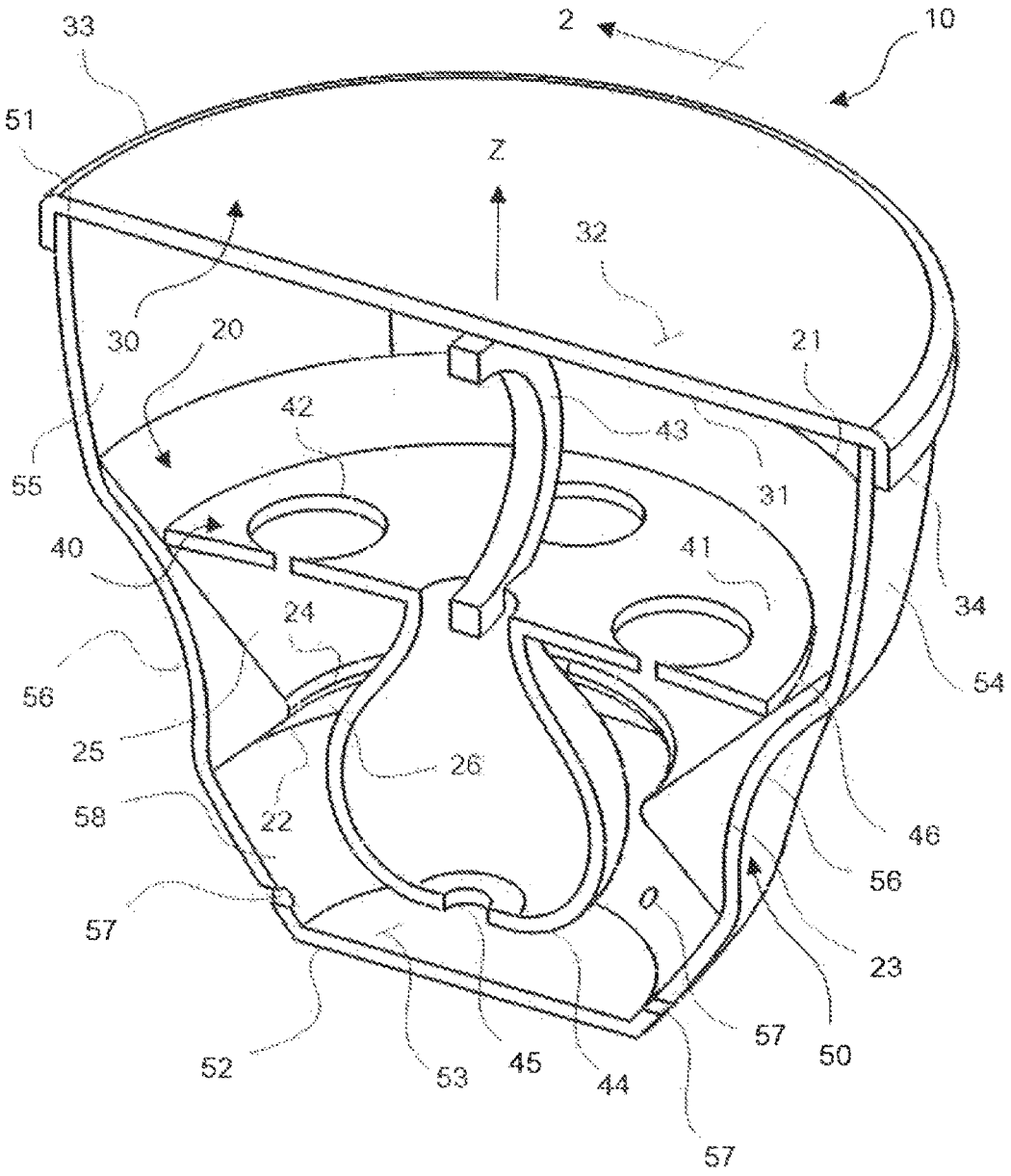
FIG. 1 is cross section view of a pacifier holder with a pacifier as per the teachings of the invention.
Figure 2:
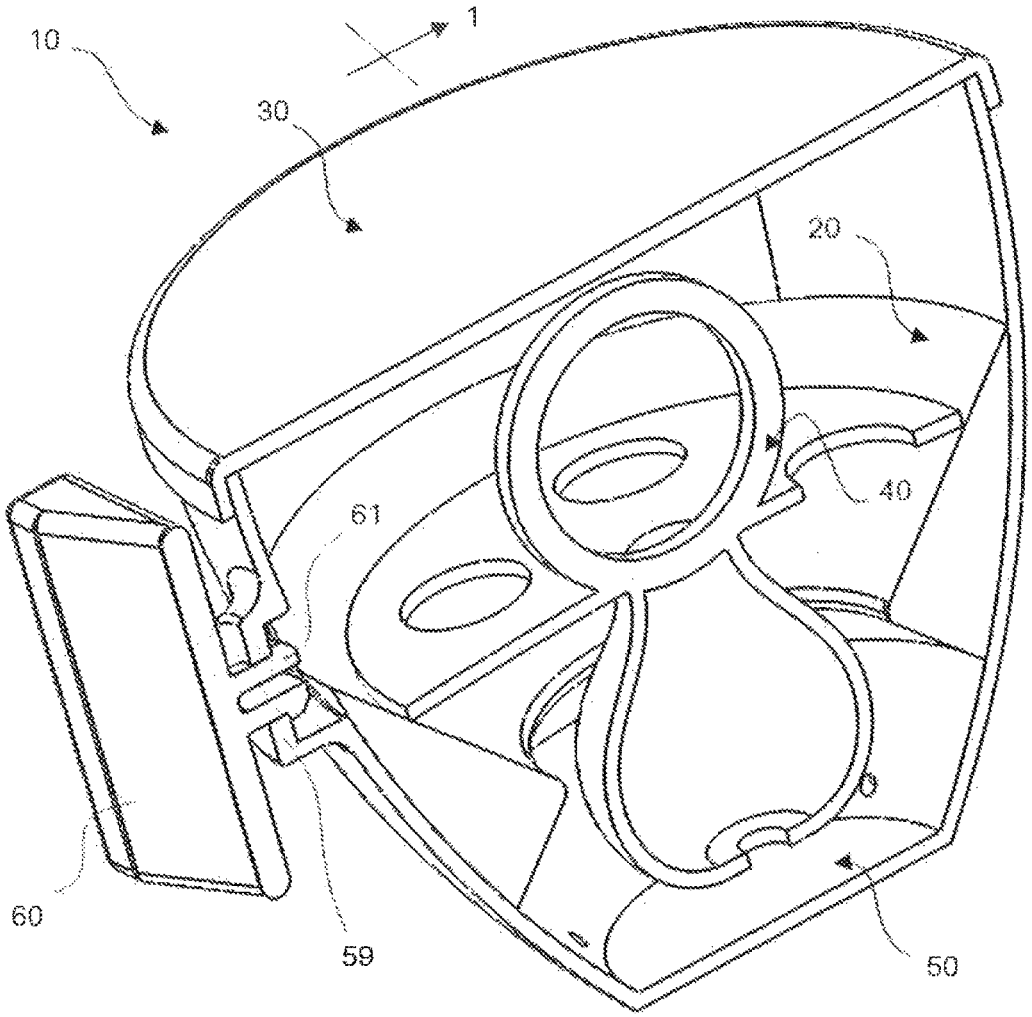
FIG. 2 is another view of the same in an orthogonal cross section.

Attention is now turned to FIGS. 1 and 2, which by assembly 10, illustrates a pacifier holder with a pacifier in it in a transversal cross section, according to the teachings of the invention.

Assembly 10 comprises insert 20, lid 30, pacifier 40 (shown only to demonstrate the use of the pacifier holder when the pacifier is not used by the baby), cup 50 and handle 60, as key components (parts). Vertical axis Z indicate upward for a natural position of assembly 10, say when it is placed on a table by flat under surface 52. Sections 1 and 2 correspond to those two figure numbers. Lid 30 is shown in closed position, while pacifier 40 is shown resulting on insert 20, which is snap-held in cup 50.

Pacifier 40 has spherical retainer disc 41 to prevent the swallowing of bib 44. Disc 41 has multiple holes for grabbing pacifier 40, which could also be grabbed by ring-handle 43. Bib 44 terminates in hole 45, through which saliva can drop to bottom 53 of cup 50. A multiplicity of weep-holes 57 facilitates drying off bib 44 while in cup 50. Retainer 41 can rest or rattle at its perimeter 46 on top surface 25 of insert 20 in any position, in which the centerline of pacifier 40 is somewhat misaligned relative to axis Z. Pacifier 40 is shown to be a single piece of rubber or other elastomer item, though it can be an assembly as well, say made of plastic, except the bib. Pacifiers often have swivel-hook-handle and their retainer can take various other shapes. A chord or lanyard is typically attached to such a handle for hanging on the baby's neck so pacifier 50 won't get dropped on to the floor, yet, even with precaution, it almost always comes in contact with unclean surfaces. That state-of-the-art practice is intended to be reformed by the invention with the hope of sparing babies from getting sick due to pacifier contamination.

Cup 50 is shown to have side constraints 56 for easier grab and for the detainment of insert 20, which splits the volume of cup 50 to upper and lower sections. The upper section is for resting the pacifier and the lower is for keeping the bib away from sidewall 58 of the cup and thereby reduce the chances of bib making a contact with the holder. Upper wall 55 of cup 50 is enlarged to facilitate dropping in of pacifier 40.

Insert 20 is preferably made of rubber and pops into cup 50 by its constriction 23 into matching constriction 56 of cup 50. A gentle upward push on it slower surface 26 can pop it out for cleaning and similar push down on its upper surface 25 would pop it down for regular use. Necking 24 separates surfaces 25 and 26. It serves as a retainer ring to pacifier 40. Upper perimeter 21 of insert 20 and lower perimeter 22 are sealed just by snug tight assembly.

Lid 30 covers cup 50 snug tight, though it may be held down magnetically or by other means, for instance, by protruding-intruding pairs of dimples on lip 34. For gentle baby touch, sharp perimeter 33 is rolled or chamfered. Underside 31 may be sprayed with disinfecting spray, which may give off germs neutralizing vapor. Topside 32 may display logo, warning, baby entertaining pictures and such (not shown).

Sections 1 and 2 are orthogonal. Section 2, shown in FIG. 2 is a longitudinal section of holder 10, with likewise components labeled the same way. Cup 50 has molded handle socket 59, which by snapping-in split extrusion 61, holds handle 60, which can be attached to various surfaces, for instance with a belt to strollers, cribs, swings, car seats, tables, chairs, etc. (not shown). Notice that there is no cup side wall constriction across the longitudinal plane, which incorporates axis Z. That may make retaining insert 20 in cup 50 somewhat weak, thought it may be sufficient for the typical gentle uses. Magnetic retainers however can strengthen its detainment as that is shown next.

Figure 3:
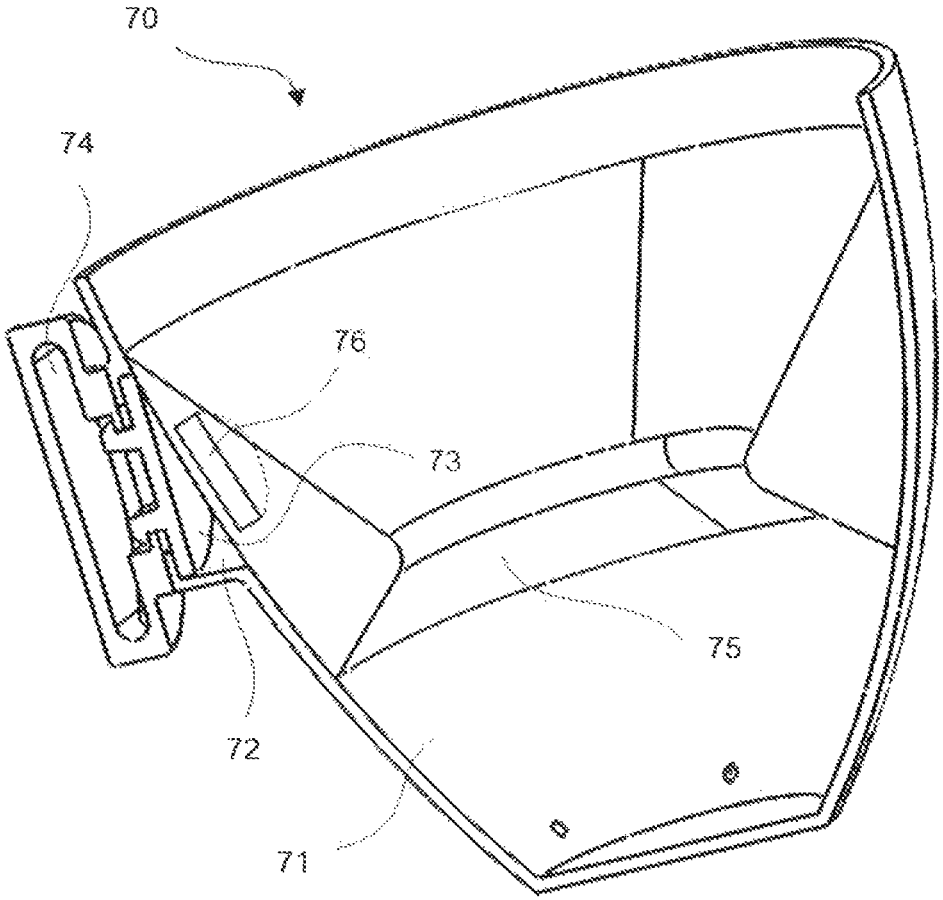
FIG. 3 is another section view of another pacifier with a through-belt-slot snap-hook and a magnetic insert retainer.

Attention is now turned to FIG. 3, which by pacifier holder assembly 70, illustrates another preferred embodiment of the invention. Holder 70 is similar to holder 50, however its cup 71 lacks constriction, and thus, its insert 75 is held down by embedded permanent magnet 76, which is attracted to handle retainer insert 73, which is made of steel, preferably powder coated to prevent its rusting. Handle 74 pops into engagement with insert 73, can swivel and turn around and accommodate a belt through its slot. Insert 73 however can be mold injected plastic with a magnet insert (not shown), which would be attracted to magnet 76. Such a magnetic hold down is however strong only near handle 60. A stronger means of hold down is illustrated next.

Figure 4:
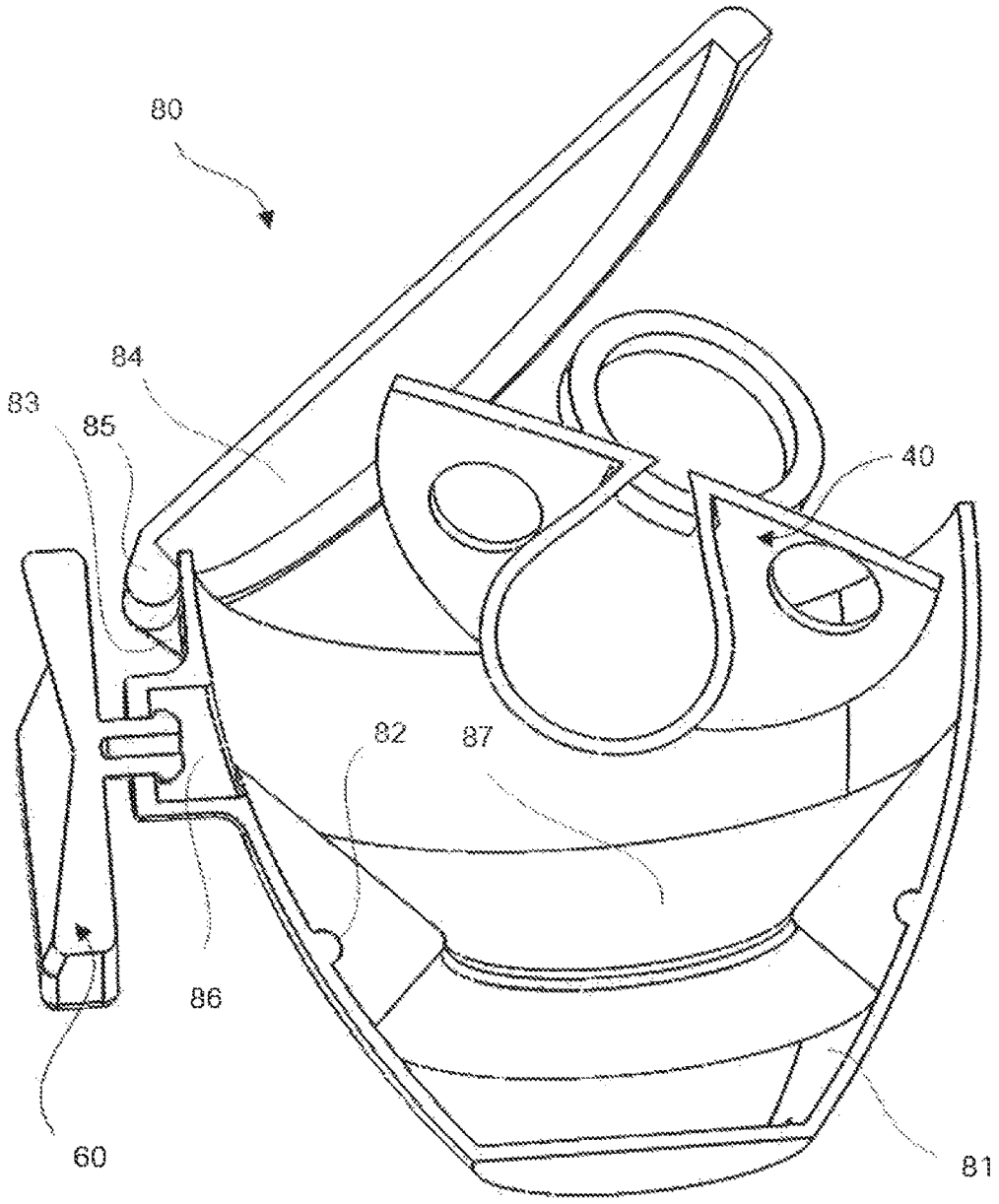

Attention is finally turned to FIG. 4, which illustrates pacifier holder assembly 80, with pacifier 40 being inserted. Cup 81 has no constriction and magnets, thus is retains rubber insert by protrusion loop 82. Handle socket 86 is similar to socket 59, thus holds handle 60 the same way. Cup 50 has two lid holder extrusions 83, which are symmetrical to the longitudinal section place, which cuts through all parts here and retains swivel lid 84 by axel extrusion 85. This ensures that lid 84 does not get lost easily, but can be popped out for cleaning when needed. Insert 87, has grove matching to protrusion 82, for firm detainment. Insert 87 can be hollow formed by plastic shell, instead of solid rubber.

Those skilled in the art can readily perceive that cup 50 need not be a smooth rotational shell but can take any suitable shape, including but not limited to ones that mimic animals or symmetrical shapes or popular cartoon characters to entertain the baby. The more colorful and lifelike or funny such sculptured shell is, the more it entertains or fascinates the baby and keeps him or her quiet for longer travels.

It is estimated that by keeping the pacifier clean with the proposed humble pacifier holder, billions of dollars can be reduced domestically with reduced doctors' visits, lost parental working hours, medicines and other associated nonproductive events.

The present invention described above is with reference to a preferred embodiment. However, those skilled in the art will recognize that changes and modifications may be made in the described embodiment without departing from the nature and scope of the present invention. For instance, hook-and-loop (Velcro) or other means of attachment may also hold down the insert in the cup. Placing napkin/pad/liner soaked in disinfecting liquid for sanitizing or an evaporative medication at the bottom of the cup is intuitive and thereby instructive herewith. The cup shape that is designed to hide music box/music player inside is also considered within the scope of the invention for being an obvious addition. The container and lid can be easily modified to house and dispense disinfecting wipes or can include dividers inside the container to keep various baby snacks separate.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A portable pacifier holder, comprising of at least a cup comprising a first constriction, and an insert operable to be retained in the cup, the insert comprising a first surface, a second surface comprising a second constriction, and a pacifier retainer ring, wherein:

the second surface is attached to the pacifier retainer ring by the first surface, and all of the first surface slopes toward the pacifier retainer ring such that the pacifier holder is adapted to receive, orient, and hold a pacifier through the insert;

the insert is retained in the cup by the second constriction of the insert cooperating with the first constriction of the cup; and the cup further comprising at least one weep-hole located below the insert at the bottom of the cup, configured to facilitate the drying of the pacifier and insert;

the cup further containing indented side constraints around an outer side surface of the cup, configured to detain the insert and prevent slippage while being held by a user;

the pacifier holder comprises a handle for attaching the pacifier holder to a substantially solid object, wherein the handle is operable to swivel the cup in relation to the handle such that the cup is substantially upright;

wherein the pacifier rests on the first surface of the insert such that a nipple of the pacifier passes through the pacifier retainer ring of the insert.

2. The pacifier holder of claim 1, wherein the handle is affixed to an outer side surface of the cup.

3. The pacifier holder of claim 2, wherein the insert is retained in the cup by at least magnetic means.

4. The pacifier holder of claim 2, wherein the insert is retained in the cup by at least matching protrusion-extrusion pairs.

5. The pacifier holder of claim 1, wherein the cup further comprises means to sanitize an inside volume of the cup, at least for a limited time, until such measure is needed to safe-keep said pacifier.

6. The pacifier holder of claim 5, wherein the cup further comprises means to medicate by evaporation of a medication held in the inside volume, at least for a limited time, until such measure is needed to safe-keep said pacifier.

7. The pacifier holder of claim 1, wherein the cup further comprises a lid.

8. The pacifier holder of claim 7, wherein the cup further comprises means to vent an inside volume of the cup when the lid is closed.

9. The pacifier holder of claim 8, wherein the cup further comprises means to capture and retain, at least partially or temporarily, saliva dropping from the pacifier.

10. The pacifier holder of claim 1, wherein the cup and the insert are separable with ease for cleaning.

11. The pacifier holder of claim 1, wherein the cup and the insert are dishwasher safe.

12. The pacifier holder of claim 7, wherein all components of the pacifier holder are dishwasher safe.

13. The pacifier holder of claim 7, all components of the pacifier holder are safe from breaking upon dropping from a height not to exceed 6 ft.

14. The pacifier holder of claim 1, wherein the handle comprises a belt, a clip, a rubber tie, a magnet, or a suction cup.

15. The pacifier holder of claim 1, wherein the cup comprises a flat bottom.

16. The pacifier holder of claim 1, wherein the cup comprises a circular bottom and the insert is circularly shaped.

17. A method for retaining a pacifier within a portable pacifier holder, comprising:

retaining an insert into a cup of a pacifier holder, comprising:

placing the insert into the cup such that a first surface of the insert is oriented toward an opening of the cup; and mating a first constriction of the cup with a second constriction of a second surface of the insert;

containing at least one weep-hole located below the insert at the bottom of the cup, configured to facilitate the drying of the pacifier and insert;

containing indented side constraints around an outer side surface of the cup, configured to detain the insert and prevent slippage while being held by a user;

attaching the cup to a substantially solid object, comprising:

attaching a handle of the pacifier holder to a substantially solid object; and swiveling the cup in relation to the handle such that the cup is substantially upright; and retaining a pacifier in the cup such that a bib of the pacifier rests on the surface of the insert and a nipple of the pacifier passes through a pacifier retainer ring of the insert.

18. An apparatus, comprising:

a cup comprising a first constriction, an insert operable to be retained in the cup, the insert comprising a first surface, a second surface comprising a second constriction, and a pacifier retainer ring, wherein:

the second surface is attached to the pacifier retainer ring by the first surface, and all of the first surface slopes toward the pacifier retainer ring such that the pacifier holder is adapted to receive, orient, and hold a pacifier through the insert;

the insert is retained in the cup by the second constriction of the insert cooperating with the first constriction of the cup; and the cup further comprising at least one weep-hole located below the insert at the bottom of the cup, configured to facilitate the drying of the pacifier and insert;

the cup further containing indented side constraints around an outer side surface of the cup, configured to detain the insert and prevent slippage while being held by a user;

a handle attached to the cup, wherein the handle swivels in relation to the cup, and wherein the handle attaches the apparatus to a substantially solid object.

19. The apparatus of claim 18, wherein the handle swivels such that the cup is substantially upright.

* * * * *